United States Patent [19]

Beavers

[11] Patent Number: 4,819,680

[45] Date of Patent: Apr. 11, 1989

[54] SPRING-BIASED TENT FRAME FOOT

[75] Inventor: Allan E. Beavers, Grand Junction, Colo.

[73] Assignee: T. A. Pelsue Company, Englewood, Colo.

[21] Appl. No.: 204,531

[22] Filed: Jun. 9, 1988

[51] Int. Cl.[4] ..... E04H 15/40

[52] U.S. Cl. ..... 135/104; 135/106

[58] Field of Search ..... 135/102, 104, 106, 116, 135/901

[56] References Cited

U.S. PATENT DOCUMENTS

| | | | |
|---|---|---|---|
| 1,792,669 | 2/1931 | Wickstrum | 135/104 |
| 1,792,670 | 2/1931 | Wickstrum | 135/104 |
| 2,543,684 | 2/1951 | Blanchard | 135/104 |
| 2,823,683 | 2/1958 | Smith et al. | 135/104 |
| 3,461,890 | 8/1969 | Goodrich | 135/104 |
| 4,265,260 | 5/1981 | Gillis | 135/104 |
| 4,265,261 | 5/1981 | Barker | 135/116 X |
| 4,285,354 | 8/1981 | Beavers | 135/102 |

FOREIGN PATENT DOCUMENTS

| | | | |
|---|---|---|---|
| 64846 | 7/1949 | Netherlands | 135/104 |

*Primary Examiner*—J. Karl Bell

*Attorney, Agent, or Firm*—Edwin L. Spangler, Jr.

[57] ABSTRACT

The invention relates to a spring-biased foot subassembly for use in the lower corners of a wall panel of a ground tent to yieldably resist the tension placed upon such panels when the diagonally-extending portions of the subframes supporting same in free-standing relation elongate as they move from an inwardly bowed partially folded relation out and over center where they assume a more or less straight line relation and on beyond into a fully-extended and outwardly-bowed position. The same elements that yieldably resist this tensioning of the wall panel also cooperate therewith to maintain the latter taut and under slight tension once the subframe has moved into its fully-extended and outwardly-bowed wall-supporting position.

9 Claims, 2 Drawing Sheets

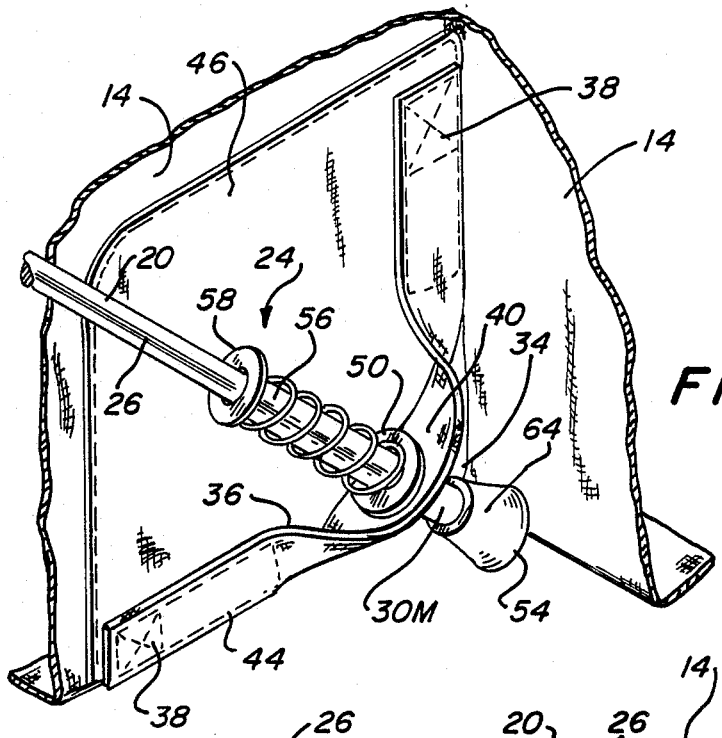
Fig_6
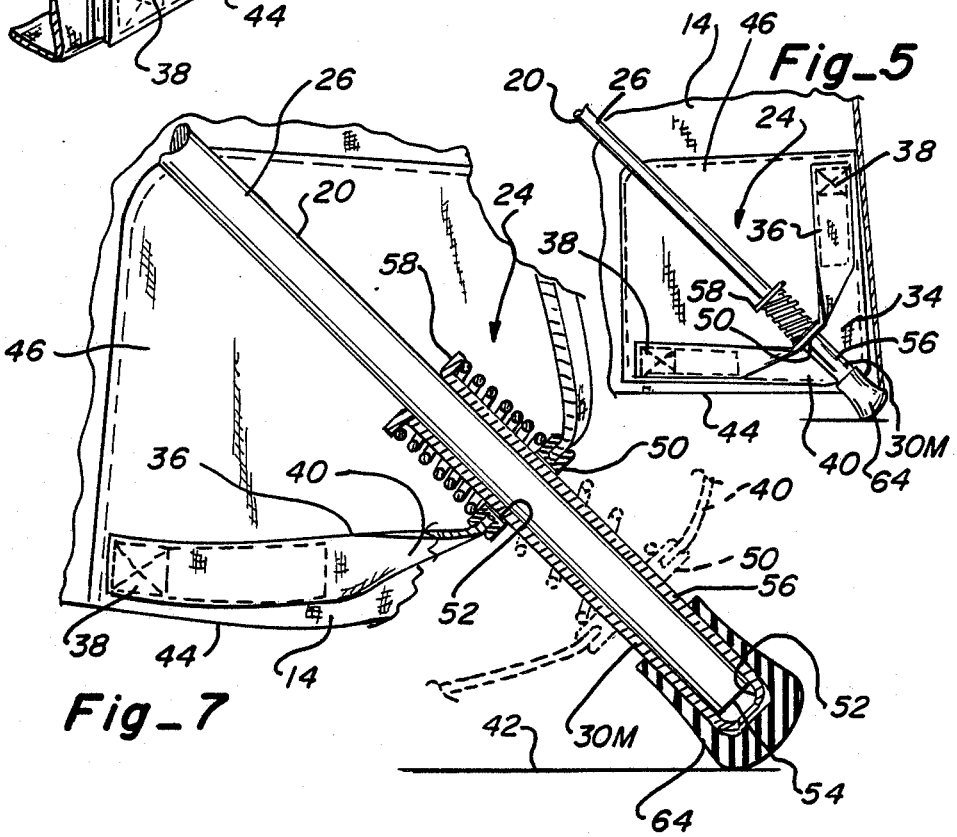
Fig_5
Fig_7

SPRING-BIASED TENT FRAME FOOT

BACKGROUND OF THE INVENTION

1. Field of the Invention

The assignee is the owner of several patents relating to ground tents, the foldable frames used in them, the hubs at the center of the frames and other features. Characteristic of these frames is a plurality of subframes each consisting of a central hub from which radiate foldable struts, generally four in number. The sides, top and rear wall of the tent are customarily provided with one such frame although in some designs, the side walls may include a second one arranged in end-to-end relation to the first. The front wall may also include such a frame, however, it is unnecessary since the side and rear subframes function in cooperation with one another and with the roof-supporting one to define a free-standing skeletal structure. The remote ends of these frames as well as the hub are connected to the sidewall and roof-forming portions of the skin such that the latter folds up inside the frame when the frame is collapsed. Sometimes this connection is formed by means of a cable connected between the strut ends which is then reaved through hems in the wall and roof panels or, alternatively, pockets formed in the corners of these panels which replace the cables.

A problem arises in keeping the skin panels taut, especially the wall panels. What causes this is the necessity for the struts to move from an essentially parallel nested relation in collapsed position, through a straight line relation and on beyond into an outwardly-bowed or obtuse-angular relation when fully extended into their operative wall-supporting position. Obviously, the diagonals of the rectangular wall surfaces defined by these struts in open position are longer when the struts occupy a straight line relation to one another than an angular or bowed one. The struts, while sometimes slightly bendable to the degree required for them to assume and maintain the aforementioned bowed relation are, nevertheless not so flexible as to keep from stressing the skin as they move through their straight line relation and on into an outwardly-bowed or obtuse-angular relation. What is needed, of course, especially with a fabric having little stretch, is to use a rather generous amount of material so as to not overstress and risk tearing it. Obviously, the net result is a skin panel that is not taut, will flap in the slightest breeze and is generally unsightly once the struts reach their fully extended outwardly-bowed or obtuse-angular relation.

2. Description of the Related Art

By way of background information, reference should be made to U.S. Pat. Nos. 3,810,482; 3,941,140; 4,026,312; 4,077,417; 4,285,354; 4,450,851; and 4,637,748, all of which relate generally to the aforementioned subject matter and are owned by the assignee. The closest prior art known to applicant is found in the U.S. Pat. Nos. to Harkness 2,869,561; McIlwaine 2,889,840; and Griesenbeck 4,590,956. The more than passing interest.

SUMMARY OF THE INVENTION

Viewed in the light of what has been said above, a need exists to provide some means for restoring the taut condition to the skin panels of a tent or similar fabric-walled collapsible structure where the frame includes diagonally-extending strut and hub subassemblies radiating from a central hub that must pass through a stress-producing position of at or near maximum overall length before assuming their final operative position in which they occupy either a bowed or an angulated relation to one another and are thus foreshortened in the sense that their remote ends are closer together. It has now been found in accordance with the teaching of the instant invention that the taut condition of the skin panels can, indeed, be restored by the novel, yet unexpected, expedient of providing grommeted straps sewn into the lower corners of the tent, passing the end of the strut remote from the hub through the hole in the grommet, providing the strut with a fixed abutment spaced above the grommet, and interposing a compression spring between the grommet and abutment. The yieldable connection thus formed functions, first of all, to permit the struts to assume a straight line relation as they move from their folded and nested relation into their fully extended operative position without stretching or overstressing the skin panels associated therewith as the spring is compressed between the grommet and fixed abutment. This same connection permits the skin panels to be dimensioned such that the spring foot and strap can cooperate with one another with the struts in fully extended ground-engaging position to keep the walls taut without, at the same time, being overstressed.

It is, therefore, the principal object of the present invention to provide a novel and improved spring foot assembly for maintaining the wall-forming panels of a tent taut without being overstressed.

A second objective is to provide an apparatus of the type aforementioned which provides a yieldable connection effective to absorb most forces tending to stretch and tear the wall-forming skin panels before any damage can occur.

Another object is that of providing a yieldable foot for ground tents and the like which is adaptable for use with both rigid and bendable frame struts.

Still another objective of the within-described invention is to provide spring feet that cushion the frames and associated structure against compression loads that might otherwise damage the struts and/or hub.

An additional object of the invention herein disclosed and claimed is to provide means for accommodating fabric shrinkage in a tent skin or similar envelope.

Further objects are to provide a spring foot for use in tent corners that is simple, versatile, inexpensive, compact, lightweight and strong as well as one that is readily adaptable for use in various other skin-covered frame applications.

BRIEF DESCRIPTION OF THE DRAWINGS

FIG. 5 is an enlarged fragmentary detail taken along line 5—5 of FIG. 3 and showing the foot in the retracted position it will occupy when the subframes are fully extended;

FIG. 6 is a fragmentary detail to even a larger scale than FIG. 5 showing the foot in perspective and in the same retracted position; and, FIG. 7 is a fragmentary detail to even a further enlarged scale than that shown in FIG. 6 showing the foot in section but in the same extended position in which it is seen in FIG. 7.

DETAILED DESCRIPTION OF THE DRAWINGS

Figures 1, 2, 3, 4:
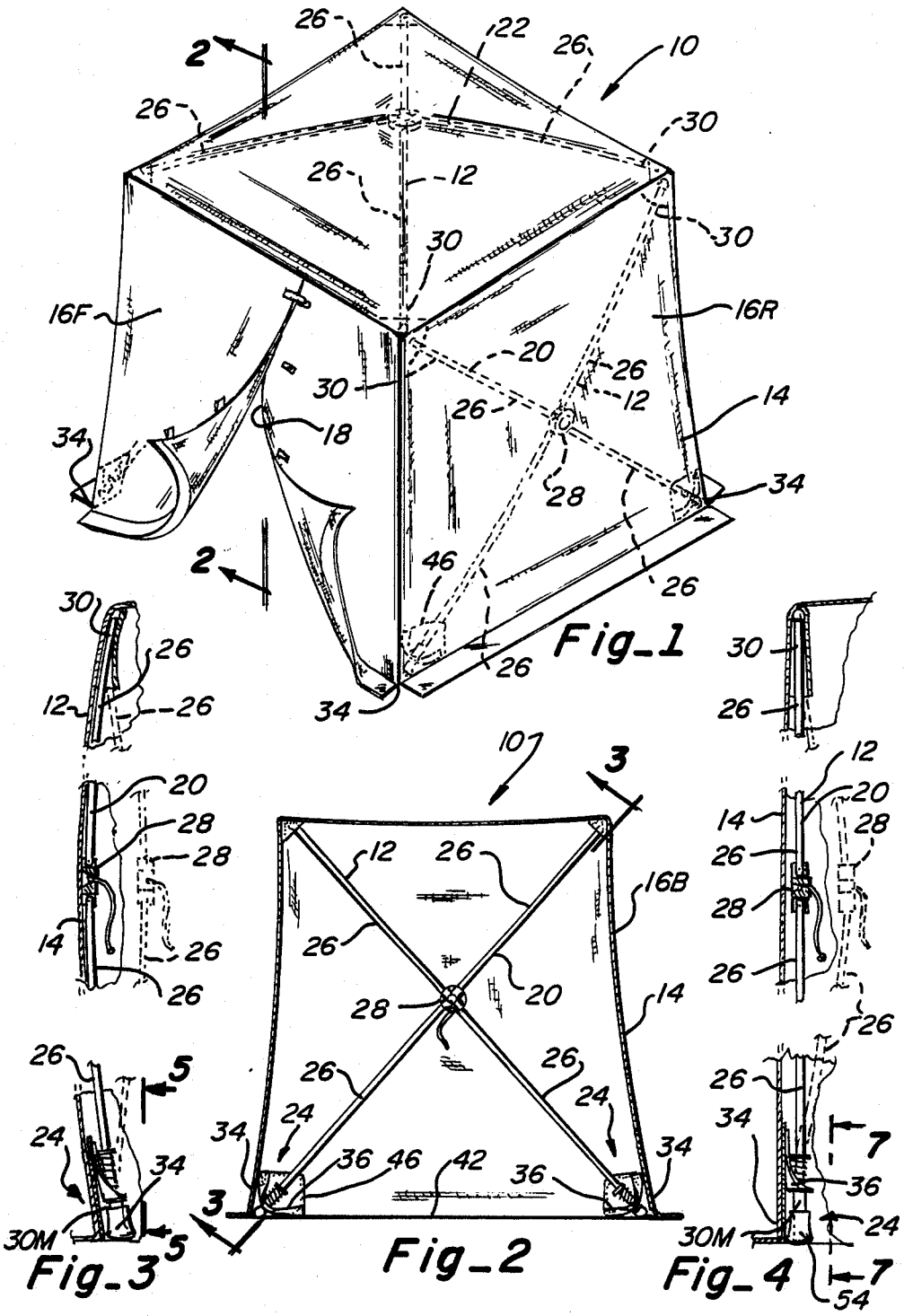
FIG. 1 is a perspective view of a ground tent in which each of the lower corners is equipped with the spring foot of the present invention.
FIG. 2 is a section taken along line 2—2 of FIG. 1.
FIG. 3 is a fragmentary section to an enlarged scale taken diagonally along line 3—3 of FIG. 2.
FIG. 4 is a fragmentary section similar to FIG. 3 showing how the diagonally-disposed struts elongate as they move from a bowed or angled relationship into a straight line one.

Referring next to the drawings for a detailed description of the present invention and, initially, to FIGS. 1–4, inclusive for this purpose, reference numeral 10 has been chosen to broadly identify a ground tent of the type having a frame 12 covered by a fabric skin or covering 14. In the particular form shown, the tent has right and left sidewalls 16R and 16L, a rear wall 16B, a front wall 16F with a slit 18 in it defining an access opening, and a top or roof 18, all cooperating to produce an enclosed shelter resting on the ground or other suitable support. The frame 12 is made up of three wall-supporting subframes 20 and a single roof-supporting subframe 22, those defined by reference numeral 20 which support the sidewalls and rear wall being substantially identical while subframe 22 supporting the top is somewhat different. No subframe is shown supporting the front wall 16F nor is any required in the embodiment illustrated since the three wall-supporting subframes 20 together with the roof-supporting subframe 22 all cooperate when covered to define a free-standing walled closure while leaving the front panel uninterrupted for easy ingress and egress. The difference between subframes 20 and 22 is the fact that the latter does not include the spring foot which forms the subject matter of the present invention and which has been broadly designated by reference numeral 24. Looking at subframes 20, it can be seen that while each has four more or less radially-extending struts 26 emanating from a central hub 28, the remote ends 30 thereof differ in that those at the top are plain and thus identical to the ones radiating from subframe 22, whereas, the lower ones 30M are modified in that each is equipped with a spring foot 24 as can be seen most clearly in FIG. 2.

Before going into detail concerning the novel spring foot 24, it would, perhaps, be helpful to explain the need for the latter for which purpose reference will be had to FIGS. 3 and 4. Starting with FIG. 3, it will be seen that each diagonal of both the subframes 20 and 22 consist of a hub 28 and a pair of the struts 26 cooperating with one another to define a subassembly which moves from a partially extended position represented by phantom lines in which it is bowed inwardly into a fully-extended position shown in full lines wherein it is bowed outwardly. It should, perhaps, be mentioned here that when the term "bowed" is used herein it is intended to cover both the situation in which the struts are flexible so that they can assume a curved shape as well as that in which the struts are rigid and assume an obtuse angular relationship to one another with the hub at the apex of the angle thus formed. It is in the latter or full line position in which the aforementioned roof and wall-supporting subassemblies bow out against the skin covering them and cooperate with one another to produce the free-standing structure of FIG. 1. The fully-folded or collapsed position of these subframes has not been illustrated since it has nothing to do with the present invention although reference can be made to several of assignees previously-mentioned patents for these details.

In passing from the inwardly-bowed phantom line position of FIGS. 3 and 4 into the outwardly-bowed fully-extended position of FIG. 3 it must, of necessity, pass through what is essentially a straight line intermediate position shown in full lines in FIG. 4. Here again, when the term "straight line position" is used with reference to the diagonally-extending strut and hub subassemblies it is intended to cover the situation in which the adjacent strut ends are, in fact, aligned as well as that in which they are in side-by-side slightly overlapped relation at the hub in the manner shown in U.S. Pat. No. 3,941,140.

If both remote ends 30 and 30M of the crossed diagonally-extending strut and hub subassemblies are secured in pockets 32 like those found in the upper corners and, in addition, the skin will not stretch to any significant degree, the only solution to accommodate the elongation of the aforementioned subassemblies as they assume the straight line relation seen in full lines in FIG. 4 is to provide the tent wall with an excess of fabric. Then, of course, when the diagonally-extending subassemblies pass over center and into their fully-extended bowed-out position shown most clearly in FIG. 3 where its remote ends move closer together, the excess fabric will sag and produce an unsightly wall. Applicant's spring foot provides the answer to this sagging problem.

Turning the attention to all the figures of the drawings, and in particular to FIGS. 6, 7 and 8, it will be seen that each of the lower corners 34 of the tent are provided with a heavy web strap 36 sewn at both ends 38 to its wall 16R, 16L or 16B leaving a diagonally-extending portion 40 therebetween which upon being rotated a quarter of a turn lies spaced a distance of a few inches from the corner 34 and above the ground 42 or other supporting surface. In the particular form shown, one of the end portions 38 of the strap is sewn along the lower edge 44 of the particular wall while the other end portion extends upwardly along the corner defined by the juncture between the latter and the adjacent wall whether it be sidewall, front wall or rear wall. There are, of course, other locations where the strap ends 38 can be sewn so long as they support the diagonally-extending portion 40 against the thrust load imposed upon the latter in the manner to be explained in detail presently when the diagonally-extending strut and hub subassemblies elongate as they move over center. FIGS. 1, 2, 6, 7 and 8 also show a preferred construction in which reinforcing patches 46 are sewn in place between each wall panel and the strap ends 38.

With specific reference to FIGS. 6, 7 and 8, it can be seen that the diagonally-extending portion 40 of each strap 36 is provided with a grommet 50 encircling and reinforcing a hole 52 in the latter. The ground engaging ends 54 of each strut and hub subassembly is housed in a sleeve 56 shown terminating at its upper end in a stop-forming annular flange 58. This sleeve is permanently fastened to the strut end through the use of suitable adhesives or some other fastening means. The sleeve is sized to slide freely within the grommet 50, the latter element together with annular stop-forming flange 58 defining spaced abutments confining coiled compression spring 60. In the particular form illustrated, the lower end 62 of the sleeve is shown crimped over the ground-engaging end 54 of the strut and, in addition, a rubber foot 64 is added covering both.

Now, since these ground-engaging feet 54 provide the only support for the tent they, obviously, must rest upon the ground at all times. Thus, with the feet 64 positioned on the ground and as the subframes are pushed outwardly from the inside from the inwardly-bowed phantom line position of FIG. 4 and into the straight line full line position shown in the latter, the wall-forming skin panels which have been sized to be taut when the subframes occupy the fully extended bowed-out position shown in full lines in FIG. 3, will pull up off the ground from the phantom line position shown in FIG. 7 into the full line position shown therein because there is insufficient material to accommodate the elongation of the diagonally-extending strut and hub subassemblies. Looking at this another way, the position of the strut and hub subassemblies as well as that of the spring foot 24 shown in FIGS. 1 and 2, full lines in FIGS. 5 and 6, and phantom lines in FIG. 7 is precisely that in which these elements occupy in the fully extended position of the subframes, i.e. with the bottom edges 46 of the tent resting on the ground and the frame and associated skin in free-standing position. I should also be noted that when these diagonally-extending strut and hub subassemblies are bowed in slightly as shown in phantom lines in FIGS. 3 and 4, essentially this same relationship will appear to exist except that the aforementioned subassemblies are bowed in instead of out. On the other hand, it is only when these subassemblies assume their straight line relation that the lower struts extend through their respective grommets, the skin panels retract into the full line position of FIG. 7 and the spring 60 is anywhere near fully compressed. Note, however, that even when the assembly is fully extended as seen in all but FIGS. 4 and 7, spring 60 is preferably left still partially compressed to maintain tension on the skin panels and keep them taut. This is achieved by careful dimensioning of the skin panels relative to the subframes and their spring feet but it is, nevertheless, worthwhile and rather easily accomplished. Thus, the spring feet 24 serve two functions, the first being that of accommodating the elongation of the diagonally-extending hub and strut subassemblies without having to provide extra material in the skin panels. The second function is one of stretching the fabric skin panels taut by keeping the springs 60 partially compressed at all times the frame is extended into its operative wall-forming relation.

I claim:

1. In a tent with essentially non-stretchable four-sided fabric wall panels having upper and lower corners supported in free-standing relation by foldable subframes consisting of a centrally-located hub from which radiate at least four struts, crossed pairs consisting of one upper strut and one lower strut of which define intersecting diagonals having the remote ends of the upper two struts secured in the upper corners of the panel while the remote ends of the lower two struts rest on the ground, and in which each such subframe is movable from a first partially-folded position wherein the diagonals formed by the strut pairs and hub are bowed inwardly out into a third fully-extended and outwardly-bowed panel-supporting position after passing through a second intermediate substantially straight line relation in which the diagonals are significantly elongated, the improvement which comprises: first strut-end-receiving apertured abutments attached to the wall panel in spaced relation above the lower corners thereof, a second abutment attached to each lower strut in spaced relation above the terminal end thereof, and a loose wound helical compression spring mounted on each lower strut below the second abutment, said spring and first and second abutments cooperating with one another and with the wall panel upon elongation of the diagonals to yieldably resist the stretching of said panel when the terminal ends of said lower struts are inserted within the apertures in said first abutments for reciprocating movement within the latter.

2. The improvement as set forth in claim 1 wherein: the first abutment comprises a strap having a grommet therein defining the aperture.

3. The improvement as set forth in claim 1 wherein: the second abutment comprises a sleeve attached to the remote end of each of the lower struts, said sleeve being sized for insertion into the spring and for free-sliding movement within the aperture in the first abutment, and said sleeve carrying a spring-abutting annular flange.

4. The improvement as set forth in claim 1 wherein: the spring and first and second abutments also cooperate with one another and with the wall panel to maintain the latter taut and under tension when the subframe is in its third outwardly-bowed and fully-extended position.

5. The improvement as set forth in claim 2 wherein: the strap includes end portions and a medial portion, the end portions being attached to the wall panel and the medial portion being rotated approximately a quarter turn relative to said end portions and equipped with the grommet.

6. The improvement as set forth in claim 3 wherein: the sleeve is crimped over the terminal end of the lower strut, and wherein a ground-engaging foot encases the terminal end of the strut and crimped sleeve end.

7. The improvement as set forth in claim 5 wherein: the medial portion of the strap is inclined diagonally in approximately right angular relation to the strut end engaged therewith.

8. The method of accommodating the elongation of a diagonally-extending hub and strut subassembly forming a part of a tent subframe as it moves from an inwardly-bowed partially folded position over center into an outwardly-bowed wall-panel-supporting relation which comprises: securing the ends of the upper struts in each diagonally-extending strut subassembly to the upper corners of the panel, providing an apertured abutment spaced above the ground in the lower corners of the panel, passing the lower ends of each of the lower struts in the diagonally-extending strut subassemblies through the apertures in the apertured abutments, providing the lower struts with fixed abutments spaced above the apertured abutments, and mounting a loose-wound helical compression spring on the lower struts between the apertured and fixed abutments, said spring being sized and adapted to cooperate with said abutments and yieldably resist forces tending to stretch the wall panel diagonally.

9. The method as set forth in claim 8 in which the spring and abutments are sized and spaced to cooperate with one another and with the wall panel to maintain the latter taut and under tension when the subframe is fully-extended into its outwardly-bowed position.

* * * * *